US010529465B1

(12) United States Patent
Ku et al.

(10) Patent No.: US 10,529,465 B1
(45) Date of Patent: Jan. 7, 2020

(54) WATERPROOF SIGNAL CABLE STRUCTURE

(71) Applicant: YFC-BONEAGLE Electric Co., Ltd., Taoyuan (TW)

(72) Inventors: Ying-Ming Ku, Taoyuan (TW); Mei-Yao Wang, Taoyuan (TW)

(73) Assignee: YFC-BONEAGLE ELECTRIC CO., LTD., Taoyuan (TW)

( * ) Notice: Subject to any disclaimer, the term of this patent is extended or adjusted under 35 U.S.C. 154(b) by 0 days.

(21) Appl. No.: 16/365,643

(22) Filed: Mar. 26, 2019

(51) Int. Cl.
*H01B 11/02* (2006.01)
*H01B 7/282* (2006.01)
*H01B 3/44* (2006.01)

(52) U.S. Cl.
CPC ..... *H01B 7/2825* (2013.01); *H01B 3/443* (2013.01); *H01B 11/02* (2013.01)

(58) Field of Classification Search
CPC ..... H01B 7/2825; H01B 3/443; H01B 11/02
USPC ..... 174/70 R
See application file for complete search history.

(56) References Cited

U.S. PATENT DOCUMENTS 5,022,344 A * 6/1991 Kundis ..... B05C 11/06 118/303
5,389,442 A * 2/1995 Arroyo ..... G02B 6/4432 385/103
5,649,041 A * 7/1997 Clyburn, III ..... G02B 6/441 385/109
6,103,317 A * 8/2000 Asai ..... G02B 6/4494 106/14.05
6,278,826 B1 * 8/2001 Sheu ..... G02B 6/4494 385/109
6,495,762 B2 * 12/2002 Arzate ..... H01B 11/02 174/113 R
8,036,509 B2 * 10/2011 Parris ..... G02B 6/4429 385/109
8,452,142 B1 * 5/2013 Laws ..... G02B 6/4401 385/101
9,728,302 B1 * 8/2017 McNutt ..... H01B 7/295
2005/0211453 A1 * 9/2005 Arzate ..... H01B 11/007 174/40 R
2007/0066124 A1 * 3/2007 Park ..... H01B 11/06 439/418
2014/0367142 A1 * 12/2014 Arzate ..... H01B 11/007 174/107
2016/0306129 A1 * 10/2016 Hurley ..... G02B 6/4434

* cited by examiner

*Primary Examiner* — Andargie M Aychillhum
*Assistant Examiner* — Michael F McAllister

(57) ABSTRACT

A signal cable structure includes a set of strands, an outer insulation tube and a water swellable powder. The set of strands includes a plurality of twisted pairs. The twisted pairs are enclosed to form a center portion, and each of the twisted pairs includes two wires intertwined with each other. The outer insulation tube sheaths the set of strands; an outer ring portion is surrounded outside the set of strands and formed between the outer insulation tube and the set of strands. The water swellable powder is distributed in the outer ring portion, and the center portion of the set of strands is not distributed with the water swellable powder. Thereby, a signal cable with waterproof performance is provided.

12 Claims, 4 Drawing Sheets

WATERPROOF SIGNAL CABLE STRUCTURE

BACKGROUND OF THE INVENTION

Field of the Invention

The present invention generally relates to signal cables and, in particular to a waterproof signal cable structure.

Description of Prior Art

Signal cables are often used as connections in electronic devices for transmitting video signals or power. In addition, signal cables can be used in various places and environments. However, when external moisture penetrates into the signal cables, it will adversely affect the transmit capability; therefore, how to provide a waterproof signal cable is a target of the industry.

Moreover, most waterproof structure of a traditional signal cable is wrapped with aluminum foil, and then an insulation layer covers the aluminum foil to isolate the moisture. However, the effect of insulating moisture by wrapping an aluminum foil is not so good; besides, the outer insulation layer will be deteriorated after a long time of use so that moisture could likely to be penetrated. Thus, the signal cables will be damaged.

In view of the above drawbacks, the Inventor proposes the present invention based on his expert knowledge and elaborate researches in order to solve the problems of prior art.

SUMMARY OF THE INVENTION

Accordingly, an object of the present invention is to provide a waterproof signal cable structure to ensure that the signal cable can transmit signals, and the service life of signal cables can be extended.

In order to achieve the object mentioned above, the present invention provides a waterproof signal cable structure comprising a set of strands, an outer insulation tube and a water swellable powder. The set of strands includes a plurality of twisted pairs which are intertwined; the twisted pairs are enclosed to form a center portion, and each of the twisted pairs includes two wires intertwined with each other. The outer insulation tube sheaths the set of strands, and an outer ring portion is surrounded outside the set of strands and formed between the outer insulation tube and the set of strands. The water swellable powder is distributed in the outer ring portion, and a center portion of the set of strands is not distributed with the water swellable powder.

Comparing to the prior art, the waterproof signal cable structure of the present invention has provided with water swellable powder evenly distributed between the outer insulation tube and four pairs of twisted pairs (strands); besides, the center portion of the set of strands is not distributed with the water swellable powder. Thereby, when the water swellable powder absorbs moisture, it will be gel-like to form a barrier outside the set of strands. Therefore, external moisture will not penetrate into the set of strands so as to ensure the transmit capability of the signal cable, and the service life of the signal cable will be extended.

BRIEF DESCRIPTION OF DRAWING

The features of the invention believed to be novel are set forth with particularity in the appended claims. The invention itself, however, may be best understood by reference to the following detailed description of the invention, which describes a number of exemplary embodiments of the invention, taken in conjunction with the accompanying drawings, in which:

DETAILED DESCRIPTION OF THE PREFERRED EMBODIMENTS

In cooperation with attached drawings, the technical contents and detailed description of the invention are described thereinafter according to a number of preferable embodiments, being not used to limit its executing scope. Any equivalent variation and modification made according to appended claims is all covered by the claims claimed by the present invention.

Figure 1:
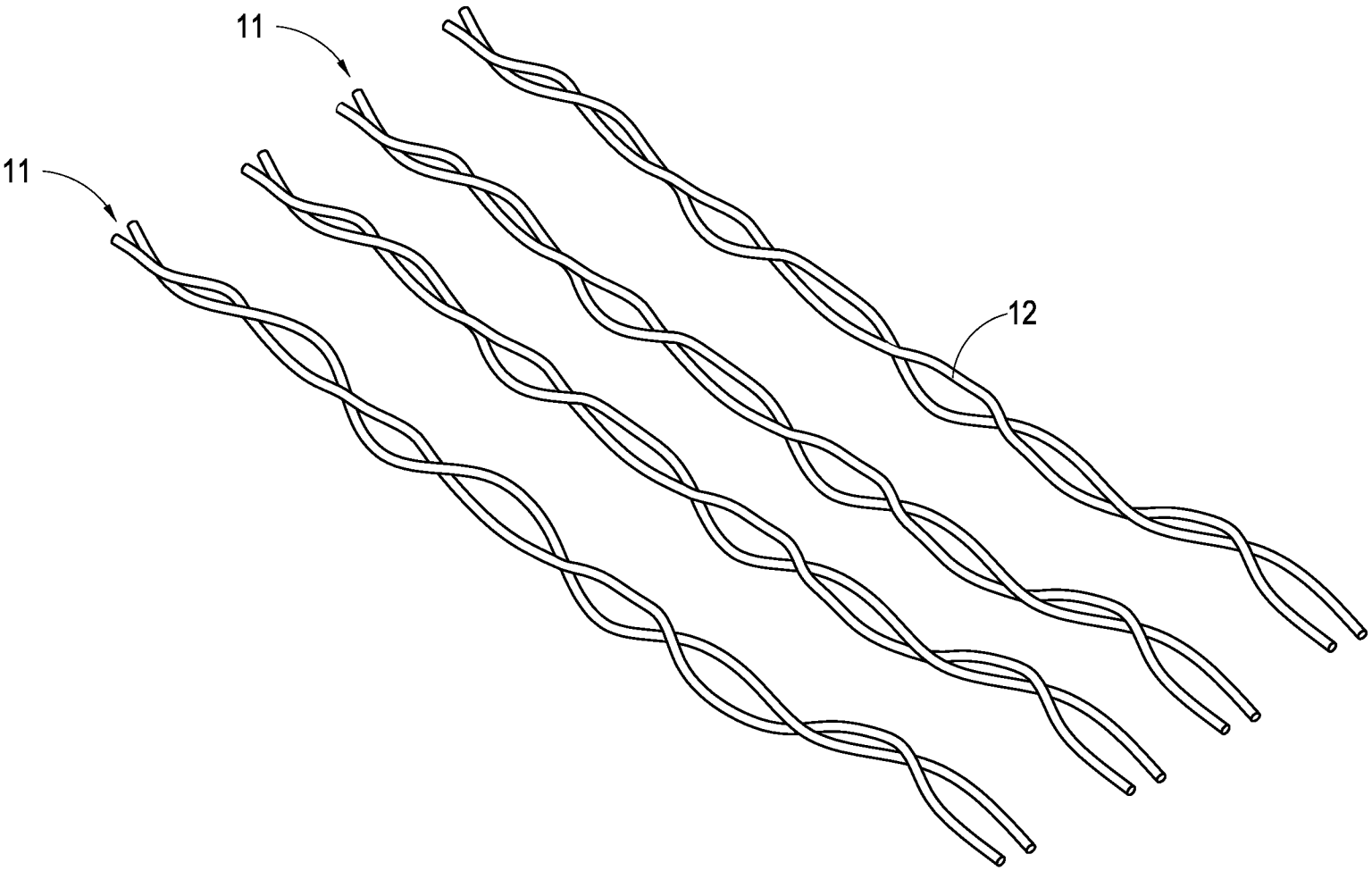
FIG. 1 is an explosion schematic view of the set of strands of the present invention.
Figure 2:
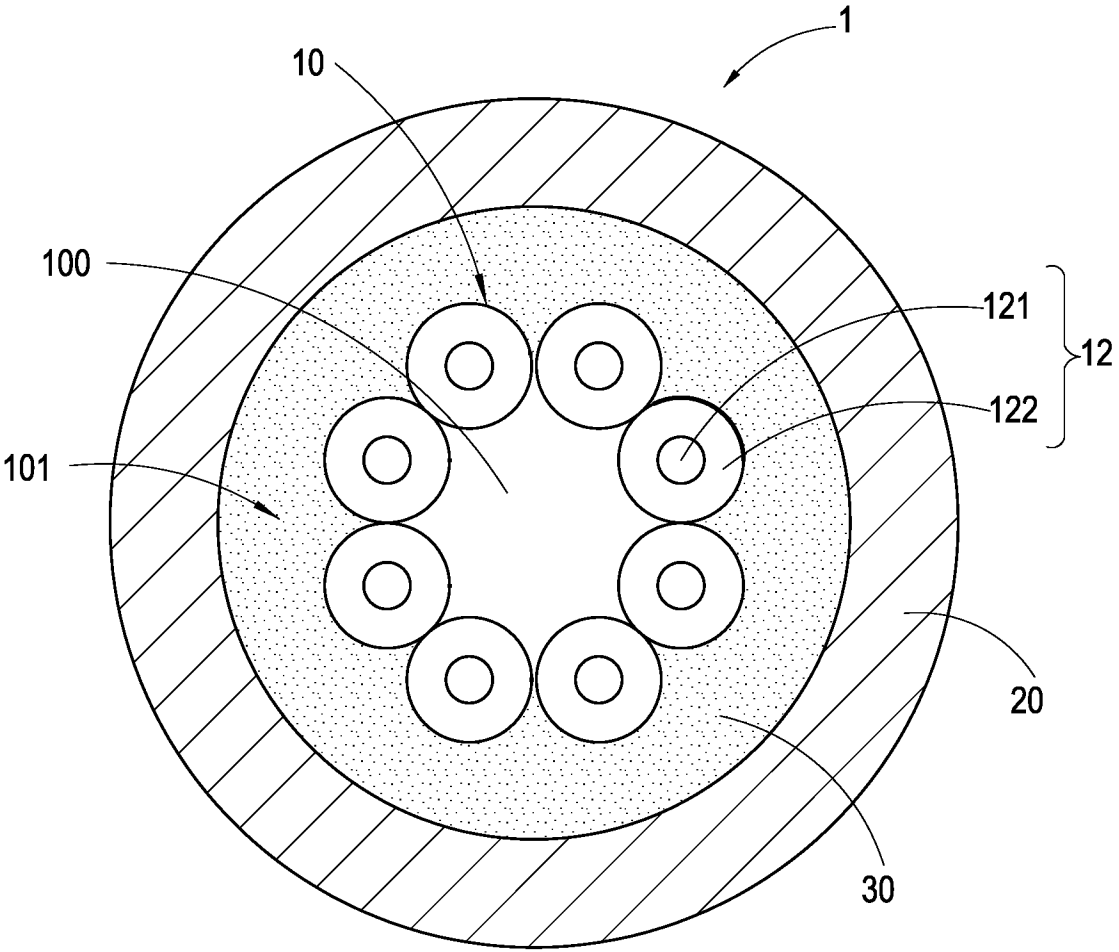
FIG. 2 is a cross sectional view of waterproof signal cable structure of the present invention.
Figure 3:
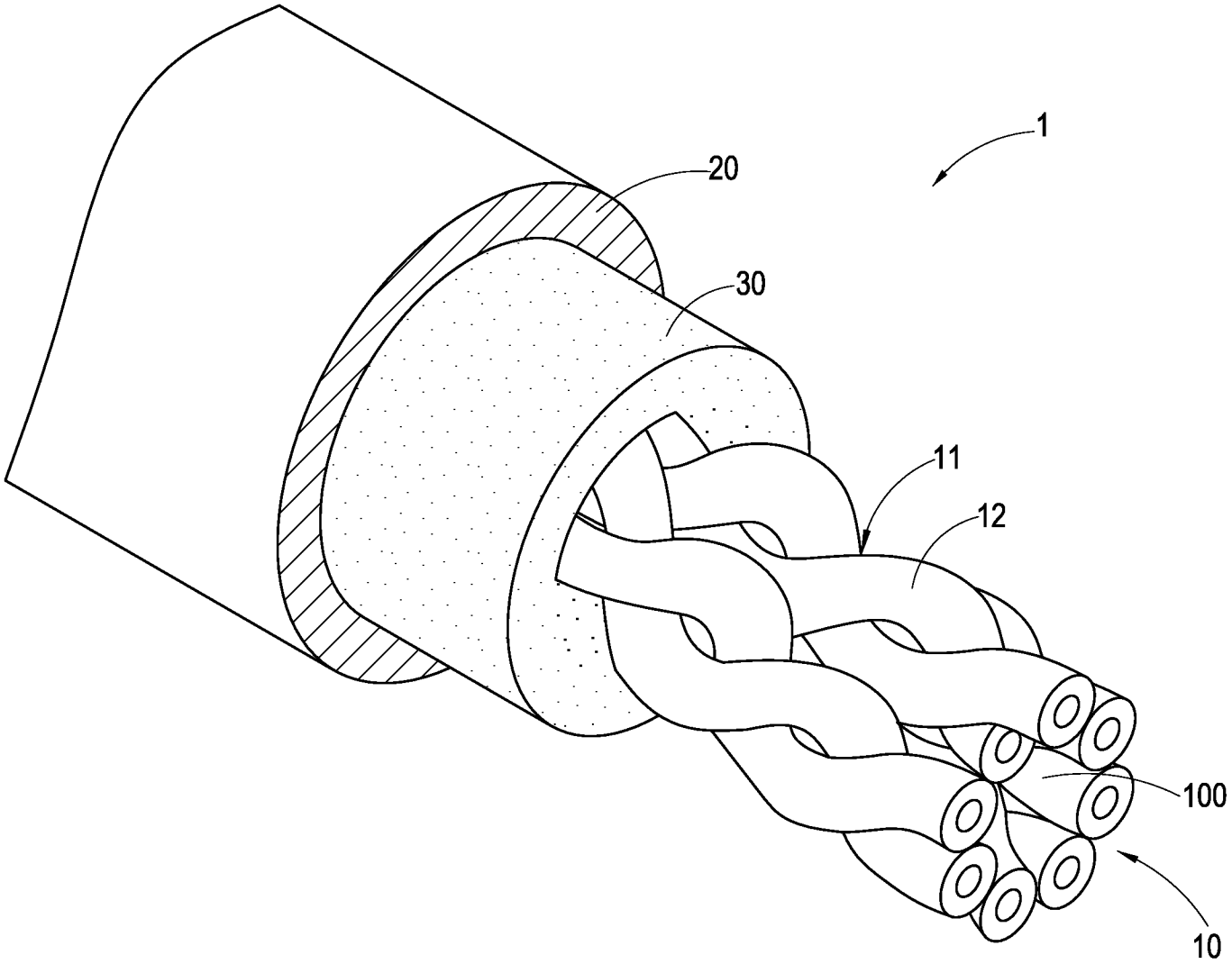
FIG. 3 is a perspective cross sectional view of waterproof signal cable structure of the present invention.

Please refer to FIG. 1 to FIG. 3, which depict an explosion schematic view of the set of strands of the present invention, a cross sectional view and a perspective cross sectional view of waterproof signal cable structure of the present invention. The waterproof signal cable structure 1 of the present invention provides a set of strands 10, an outer insulation tube 20 and a water swellable powder 30. The outer insulation tube 20 sheaths the set of strands 10, and the water swellable powder 30 is distributed between the set of strands 10 and the outer insulation tube 20 so as to complete the waterproof signal cable structure 1. More detail descriptions of the waterproof signal cable structure 1 are as follows.

The set of strands 10 includes a plurality of twisted pairs 11 which are intertwined. The twisted pairs 11 are enclosed to form a center portion 100, and each of the twisted pairs 11 includes two wires 12 intertwined with each other. In more detail, each of the wires 12 includes a signal core wire 121 and an insulation layer 122 covered the signal core wire 121.

Specifically, the set of strands 10 includes four pairs of twisted pairs 11 intertwined with each other; besides, the twisted wires 11 are arranged in a ring.

The outer insulation tube 20 can be made of polyvinyl chloride or thermoplastic elastomer. The outer insulation tube 20 sheaths the set of strands 10, and an outer ring portion 101 is surrounded outside the set of strands 10 and formed between the outer insulation tube 20 and the set of strands 10.

Moreover, the water swellable powder 30 is distributed in the outer ring portion 101 located between the outer insulation tube 20 and the set of strands 10, and the center portion 100 of the set of strands 10 is not distributed with the water swellable powder; that is, the swellable powder 30 is distributed outside four pairs of twisted pairs 11 which are intertwined with each other.

Preferably, the water swellable powder 30 is evenly distributed in the outer ring portion 101, and the water swellable powder 30 is distributed along an outer peripheral surface of the set of strands 10 in a direction of 1 longitudinal extension.

In one embodiment of the present invention, the water swellable powder 30 is super absorbent polymer which is obtained by polymerizing acrylates. Furthermore, in real practice, the water swellable powder 30 is adhered to an outer peripheral surface of the set of strands 10 via an electrostatic powder machine. It is worthy to note that the water swellable powder 30 is gel-like after absorbing moisture so as to form a barrier to wrap the set of strands 10; thereby external moisture will not penetrate into the set of strands 10.

Figure 4:
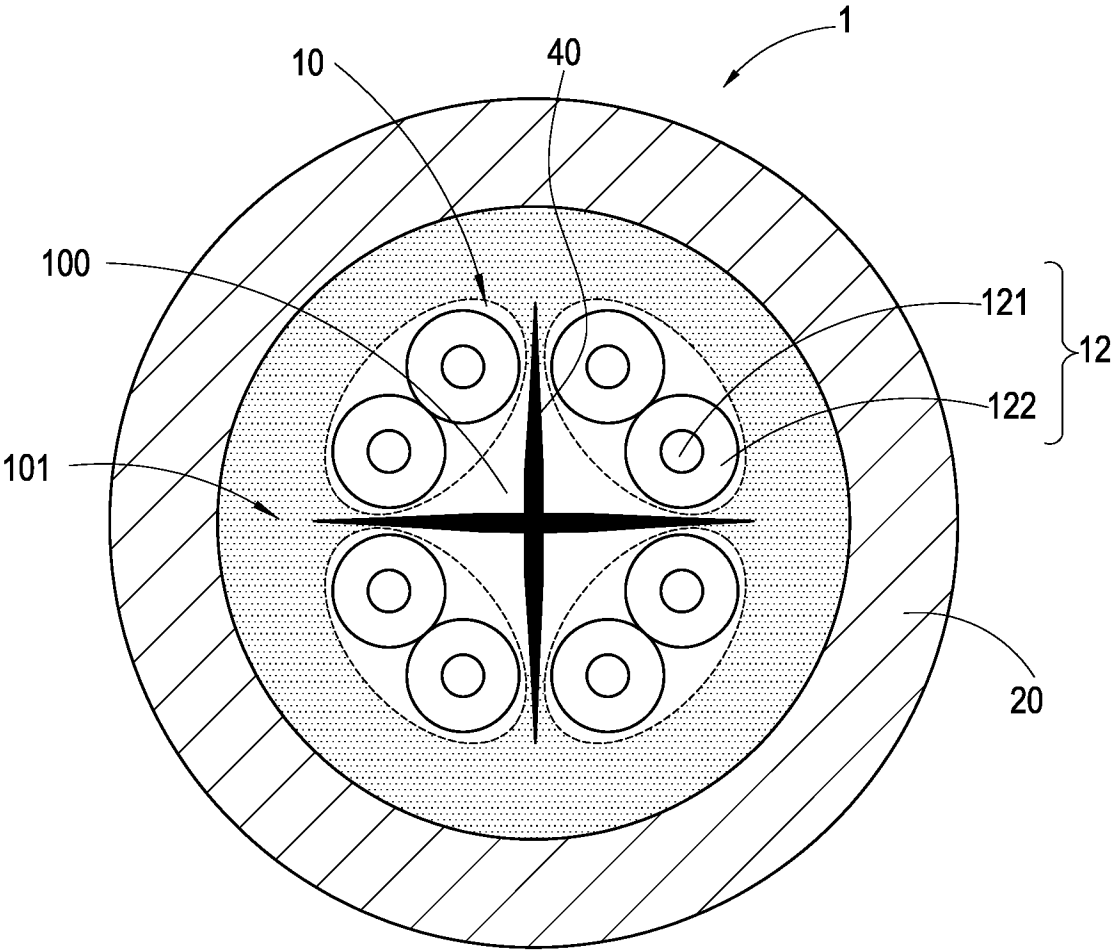
FIG. 4 is a cross sectional view of another embodiment of waterproof signal cable structure of the present invention.

Please refer to FIG. 4, which depict a cross sectional view of another embodiment of waterproof signal cable structure of the present invention. Since the transmission cables may be interfered with each other due to crosstalk, noise (EMI), or electromagnetic waves (IR) during signal transmission, spacers can be used to reduce interference effect for reducing the self-interference inside the cables. Therefore, the waterproof signal cable structure 1 of the present invention may further include a spacer 40. The spacer 40 is provided to isolate electromagnetic waves to avoid mutual interference between adjacent twisted pairs 11.

In the present embodiment, the spacer 40 is disposed between each of the twisted pairs 11. Preferably, the spacer has a cross-shaped cross section for spacing adjacent twisted pairs 11.

It should be noted that the twisted pairs 11 in the present embodiment are enclosed by dashed lines to indicate twisted pairs in pairs separately, and the structure is not different from that of FIG. 3.

Although the present invention has been described with reference to the preferred embodiment thereof, it will be understood that the invention is not limited to the details thereof. Various substitutions and improvements have been suggested in the foregoing description, and others will occur to those of ordinary skill in the art. Therefore, all such substitutions and improvements are intended to be embraced within the scope of the invention as defined in the appended claims.

What is claimed is:

1. A waterproof signal cable structure, comprising:

a set of strands including a plurality of twisted pairs; the twisted pairs being enclosed to form a center portion, and each of the twisted pairs including two wires intertwined with each other;

an outer insulation tube sheathing the set of strands; the set of strands surrounded by an outer ring portion, and the outer ring portion being located between the outer insulation tube and the set of strands; and a water swellable powder distributed in the outer ring portion located between the outer insulation tube and the set of strands, and the center portion of the set of strands being not distributed with the water swellable powder, wherein the water swellable powder directly contacts the outer insulation tube and the set of strands.

2. The waterproof signal cable structure according to claim 1, wherein the twisted wires are arranged in a ring.

3. The waterproof signal cable structure according to claim 1, wherein the set of strands includes four pairs of twisted pairs intertwined with each other.

4. The waterproof signal cable structure according to claim 1, wherein each of the wires includes a signal core wire and an insulation layer covering the signal core wire.

5. The waterproof signal cable structure according to claim 1, wherein the outer insulation tube is made of polyvinyl chloride or thermoplastic elastomer.

6. The waterproof signal cable structure according to claim 1, wherein the water swellable powder is evenly distributed in the outer ring portion.

7. The waterproof signal cable structure according to claim 1, wherein the water swellable powder is distributed along an outer peripheral surface of the set of strands in a direction of longitudinal extension.

8. The waterproof signal cable structure according to claim 1, wherein the water swellable powder is super absorbent polymer.

9. The waterproof signal cable structure according to claim 8, wherein the super absorbent polymer is obtained by polymerizing acrylates.

10. The waterproof signal cable structure according to claim 1, wherein the water swellable powder is adhered to an outer peripheral surface of the set of strands via an electrostatic powder machine.

11. The waterproof signal cable structure according to claim 1, further including a spacer, wherein the spacer is disposed between each of the twisted pairs.

12. The waterproof signal cable structure according to claim 11, wherein the spacer has a cross-shaped cross section for spacing adjacent twisted pairs.

* * * * *